United States Patent [19]

Kleven et al.

[11] Patent Number: 5,004,954

[45] Date of Patent: Apr. 2, 1991

[54] CURRENT SENSING RELAY

[75] Inventors: Lawrence P. Kleven, Attleboro; Edward A. Agranat, Weston; Jerry Crisafulli, Brookline; Hugh Robinson, Wenham; David J. Smith, Needham; Thomas Wiseley, Acton; Richard C. Fortier, Concord; Severne Johnson, Seattle; Marvin Menzin, Lexington, all of Mass.

[73] Assignee: Texas Instruments Incorporated, Dallas, Tex.

[21] Appl. No.: 454,592

[22] Filed: Dec. 21, 1989

[51] Int. Cl.[5] ..... H05B 41/36; H01H 63/10; H01H 67/00

[52] U.S. Cl. ..... 315/106; 335/106; 335/127; 335/133

[58] Field of Search ..... 315/94, 98, 106, 107, 315/119, 127, 128, 246; 335/6, 11, 15, 16, 106, 127, 133, 196, 202, 203

[56] References Cited

U.S. PATENT DOCUMENTS

| | | | |
|---|---|---|---|
| 3,219,781 | 11/1965 | Miller et al. | 335/133 |
| 3,866,087 | 2/1975 | Powell | 315/97 |
| 4,009,412 | 2/1977 | Latassa | 315/106 |
| 4,082,981 | 4/1978 | Morton et al. | 315/97 |
| 4,339,690 | 7/1982 | Regan et al. | 315/97 |
| 4,559,478 | 12/1985 | Fuller et al. | 315/224 |
| 4,568,860 | 2/1986 | Feinberg et al. | 315/255 |
| 4,661,745 | 4/1987 | Citino et al. | 315/106 |

*Primary Examiner*—David Mis

*Attorney, Agent, or Firm*—John A. Haug; James P. McAndrews; Melvin Sharp

[57] ABSTRACT

A three pole relay which operates in response to the flow of normal operating current across fluorescent lamps to activate a coil, the coil coperating a relay to open switches disposed in all of the filament lines associated with the lamp to shut off filament current while maintaining current flow across the lamps themselves.

36 Claims, 7 Drawing Sheets

CURRENT SENSING RELAY

BACKGROUND OF THE INVENTION

1. Field of the Invention

This invention relates to a current sensing relay and, more specifically, to a plural pole relay for magnetically opening a normally closed switch of a circuit upon sensing of a predetermined electrical current.

2. Brief Description of the Prior Art

In accordance with the prior art, filament windings of fluorescent lamps and the like remain in an energized state after lighting of the lamp since there is no provision for cutting off the filament current after commencement of lamp operation. This condition results in waste of energy as well as production of possibly unwanted heat which also must be dissipated in some manner. The prior art has attempted to alleviate this problem in several ways, such as by the use of timers in the filament circuits to cut off current to the filaments after a predetermined period of time. Other solutions to the problem are shown in Latassa (U.S. Pat. No. 4,009,412) wherein there is provided a secondary winding to supply lamp current and a tertiary winding to supply heater current wherein a magnetic switch is provided which senses current through the secondary winding and opens the heater current circuit in response thereto. Other prior art of this type is shown in Feinberg (U.S. Pat. No. 4,568,860), Citino (U.S. Pat. No. 4,661,745), Fuller (U.S. Pat. No. 4,559,478), Regan (U.S. Pat. No. 4,339,690), Morton (U.S. Pat. No. 4,082,981) and Powell (U.S. Pat. No. 3,866,087). These prior art solutions have been subject to one or more of several problems, these including cost, the use of normally open switches wherein the switch must close to ignite the lamps initially and switch failure therefor results in fixture lighting failure. It is therefore apparent that a mechanism is required which can provide the above described result in a more economic and failure-safe manner.

SUMMARY OF THE INVENTION

In accordance with the present invention, the above noted problems of the prior art are overcome and there is provided a simple and relatively inexpensive normally closed device to cut off filament current to all starting filaments in fluorescent lamps and the like shortly after commencement of lamp operation.

Briefly, in accordance with a first embodiment of the present invention, there is provided a three pole relay which operates in response to the flow of normal operating current across a fluorescent lamp device to activate a coil, the coil operating the relay to open switches disposed in all of the filament lines associated with the lamp to shut off filament current while maintaining current flow across the lamp itself.

The above is accomplished in accordance with a first embodiment of the invention by providing an external housing with an open bottom portion which is formed of electrically non-conducting and low magnetic permeability material. A slug or coin of electrically conductive and high magnetic permeability material is positioned within the cap and at the closed end thereof. The slug is spaced from a coil spring contact by an electrically insulating and low magnetic permeability actuator ring and spaced from an electrical contact terminal by a thin electrically insulating and low magnetic permeability layer. One end of the coil spring contact is normally biased to contact the L-shaped portion of the contact terminal between the coil spring contact and the actuator ring. The other end of the coil spring contact is coupled to a contact terminal having an L-shaped portion and a termination portion to provide a closed circuit from the external terminal portion of the contact terminal through the coil spring contact and then to the external terminal portion.

A bobbin housing a magnetic flux producing coil is disposed at the open end of the cap, and retains therein a center post of high magnetic permeability material extending through the center thereof for conducting magnetic flux provided by the coil in standard manner. The center post contacts a steel plate at the open end of the cap, steel plate being insulated from the bobbin. The end of the center post is spaced from the slug to provide an air gap therebetween, said post end preferably having a thicker end section extending to the center line of the post and a thinner end section offset from said center line. An essentially D-shaped member of electrically conducting and low magnetic permeability material is positioned on the internal exterior surface of the bobbin and partially surrounds the center post to prevent collapse of the magnetic field when the alternating current flow through the wire coil passes through the zero level.

In operation, one end of the coil spring contact is initially biased to be in contact with the contact terminal thereof and the other side of the coil spring contact is in contact with the contact terminal to provide a closed electrical circuit. When the ballast is energized, current flows through the contact terminals and the coil spring contact to the associated lamp filament to provide the required filament current thereto. At the same time, the required operating voltage is applied across the lamps. When the lamps ignite, the lamp current will cause a magnetic flux field to be induced by the coil, this field being carried by the center post and causing the slug to move downwardly to close the gap between the center post and the slug. This downward movement of the slug causes the ring actuator to move downwardly against the coil spring contact and break the connection between the coil spring contact and the contact terminals. The open circuit will cause current to be removed from the filaments, the circuit remaining in this state until current to the coil is removed.

In accordance with a second embodiment of the invention, there is provided a can of magnetic material to which is crimped a cover of non-magnetic material to form an enclosure within the can. A coil, which is the ballast efficiency switch (BES) coil of the lamp circuit, is disposed within the can, thereagainst at one end thereof and around a center post of magnetic material. A plastic flange optionally having a shorting turn therein is secured to the other end of the coil. Also positioned within the can and abutting the interior end of the center post is a steel coin which is secured to a plastic disc. The coin and plastic flange are normally biased apart by a compression spring. The center post, can and steel coin form a magnetic circuit whereby, when the coil is energized, the coin is attracted toward the coil and against the bias of the spring. A plurality of normally closed switches are maintained in the closed position by the plastic actuator when the disc is in its normal position. Upon energization of the coil, with the steel coin and plastic actuator being attracted toward the coil and away from the switches, the switches are opened to open circuits in which these switches are connected.

In accordance with a third embodiment of the invention, a can of high permeability magnetic material having an open end is provided having a bobbin housing a coil and a central core disposed at the closed end of the can. A shorting turn is optionally disposed over the bobbin and a slug or coin having plural apertures therein and an equal number of contact ring assemblies thereon with an end of each assembly extending through one of said apertures is disposed over the bobbin and spaced from the turn and bobbin core. A cover of electrically insulating and low magnetic permeability material is disposed over the slug and forms the top of the can. The cover includes plural apertures therein, preferably equally spaced about the outer region thereof, each adjacent pair of apertures designed to receive a pair of contacts for connection across one of the lamp coils.

In operation, a pair of contacts, the positioning contact and the resilient contact, will normally be in contact with the spring member. When the coil is energized, the spring member moves away from the positioning contact to open the circuit, this action taking place at all such contact pairs. The contact pairs will remain in the open position until the coil is deenergized.

DESCRIPTION OF THE PREFERRED EMBODIMENTS

Figure 1:
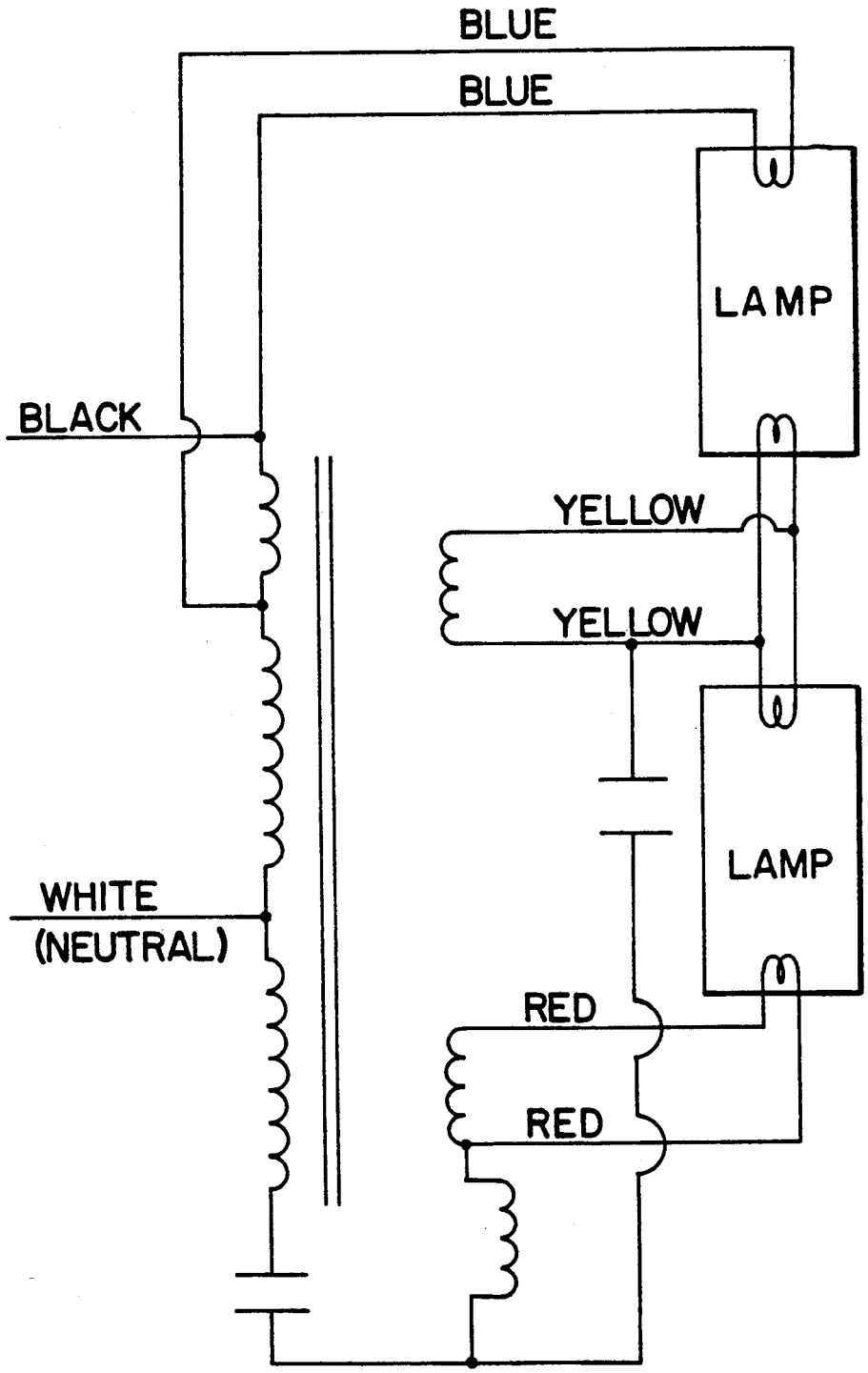
FIG. 1 is a circuit diagram of a typical two light rapid start ballast system with the lights attached.

Referring first to FIG. 1, there is shown a circuit diagram of a typical two lamp rapid start ballast which includes a pair of serially connected lamps having "blue", "yellow" and "red" coils for providing current to the filaments for starting the lamps, a BES coil and black and white terminals for providing the high voltage across the lamps to maintain operation thereof after starting in standard manner. It is well known that the starting current required by the filaments during starting is not required subsequent to starting and during operation of the lamps. Accordingly, the application of current to the filaments subsequent to starting results in a waste of energy as well as possibly unwanted production of heat. It is therefore desirable to remove the filaments from the circuit subsequent to commencement of lamp operation.

Figure 2:
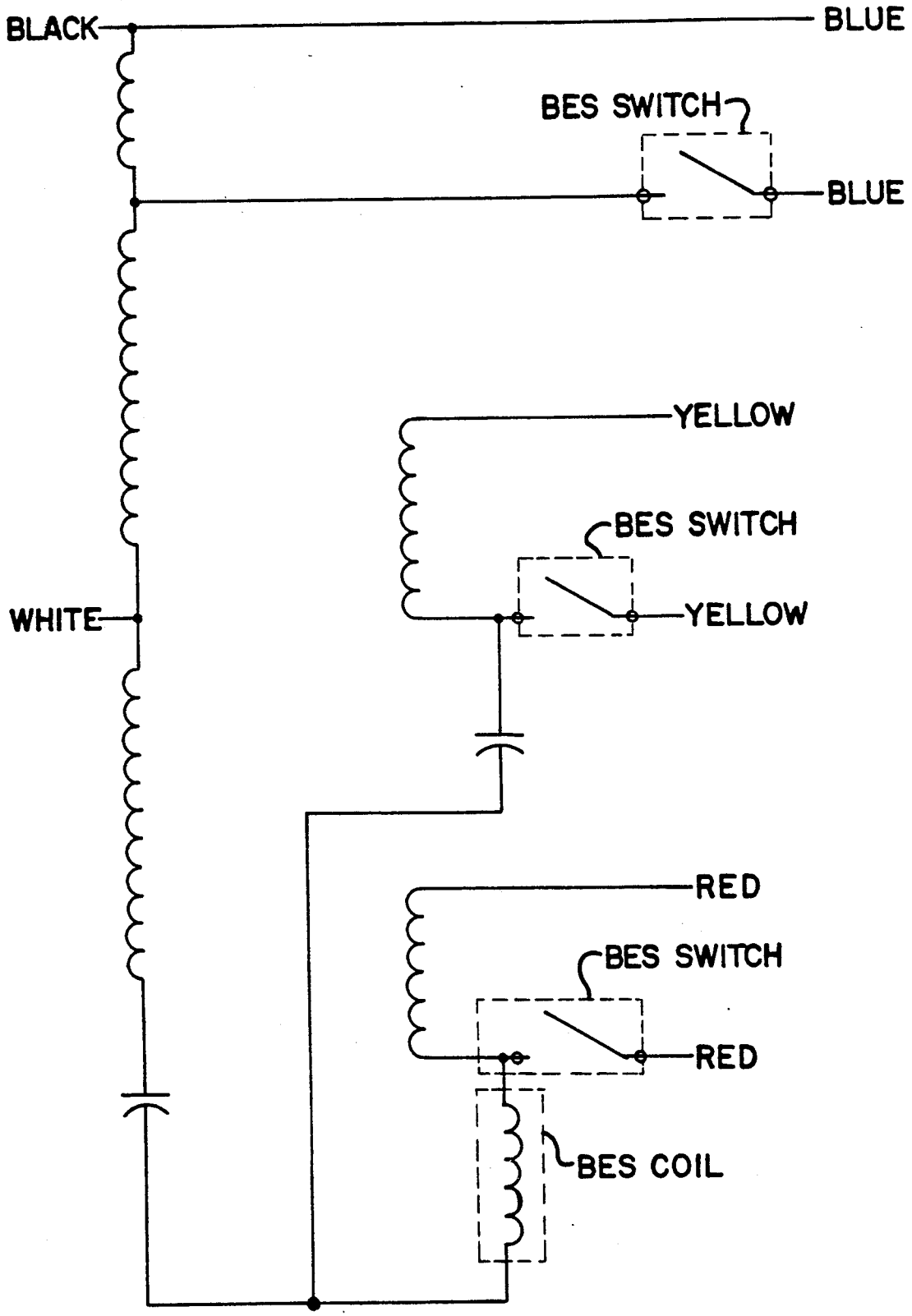
FIG. 2 is a circuit diagram of the circuit of FIG. 1 with the lamps omitted therefrom.

Referring now to FIG. 2, there is shown a circuit diagram of the circuit of FIG. 1 with the lamps omitted therefrom and with BES switches in the circuit between each of the blue, yellow and red coils and the lamps. A further BES coil is coupled to the red coil at its connections to its associated BES switch. The BES switches are closed during lamp start up and are opened after commencement of lamp operation in response to current in the BES coil to provide the energy saving described hereinabove. The invention herein relates to a relay device which provides for the opening of the three BES switches after commencement of lamp operation in response to current in the BES coil.

Figure 3A:
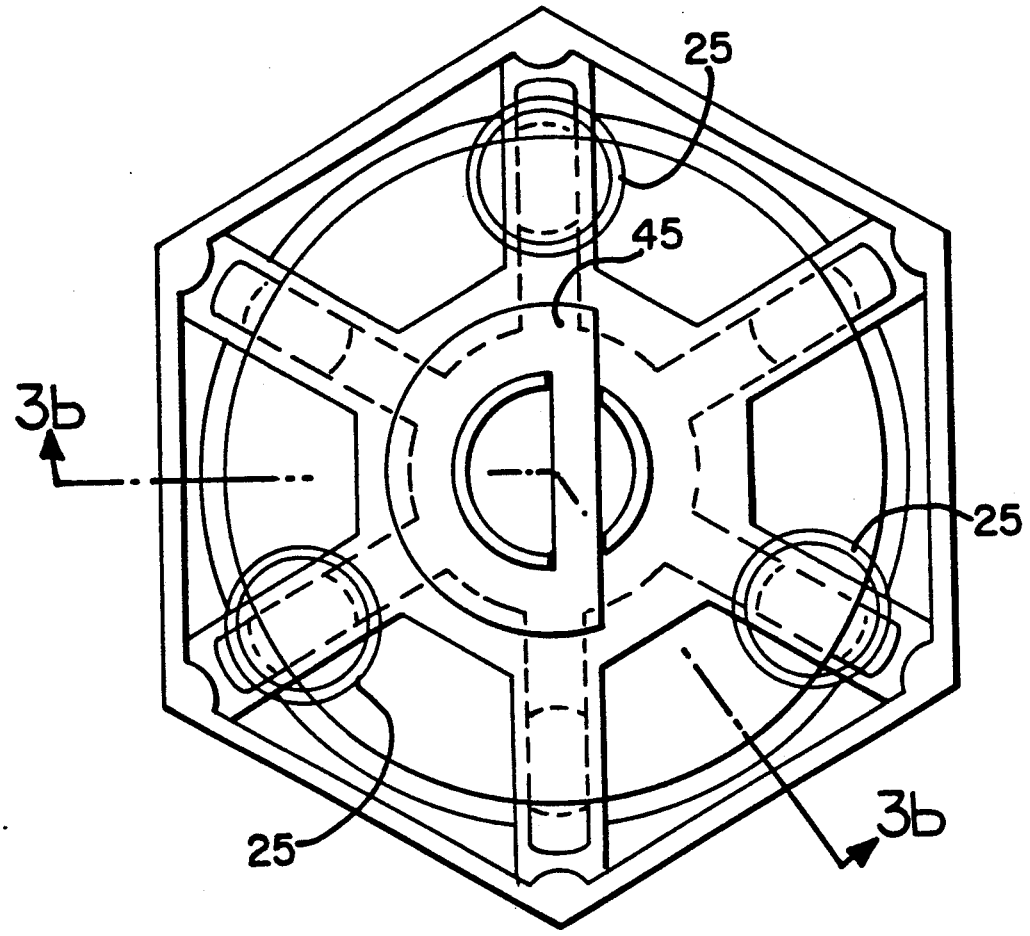
FIGS. 3*a* and 3*b* are a top view and a cross-sectional view respectively of a first embodiment of a three-pole current sensing relay in accordance with the present invention.
Figure 3B:
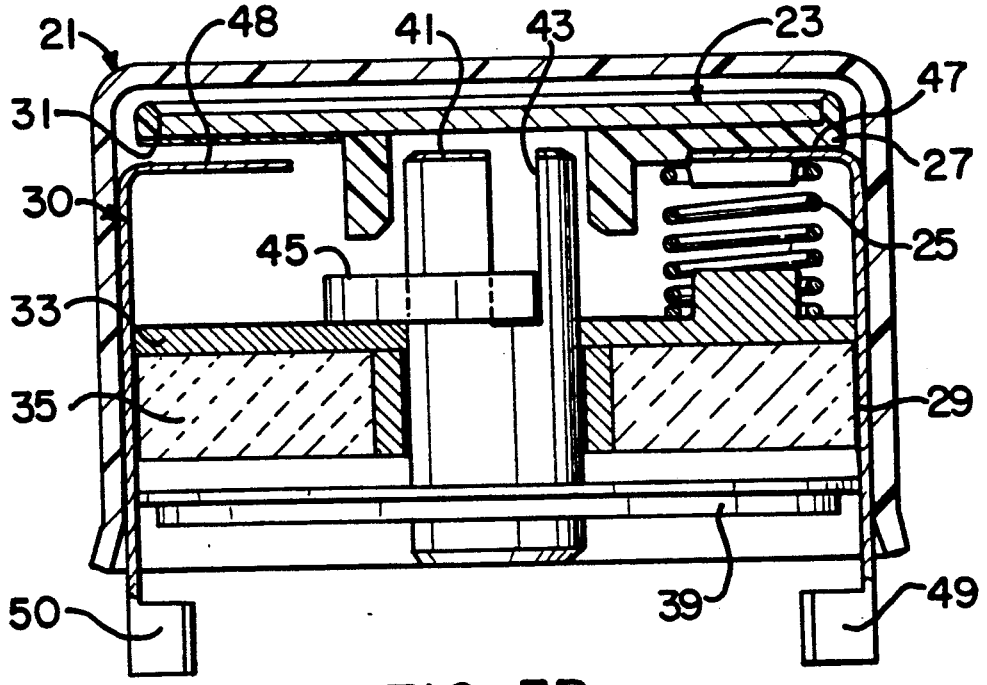

Referring now to FIGS. 3*a* and 3*b*, there is shown a top view and a cross-sectional view respectively of a first embodiment of a three-pole current sensing relay in accordance with the present invention. The relay includes an external cap or housing 21 of hexagonal cross section with open bottom portion which is formed of electrically non-conducting and low magnetic permeability material, preferably thermoplastic. Within the cap 21 and at the closed end thereof is positioned a slug or coin 23 of high magnetic permeability material, preferably steel. The slug or coin 23 is spaced from a coil spring contact 25 by a an electrically insulating and low magnetic permeability, preferably plastic, actuator ring 27 and is spaced from an L-shaped portion 47 of electrical contact terminal 29 by a thin electrically insulating and low magnetic permeability, preferably plastic, layer 31. The coil spring contact 25 is normally biased to contact at one end thereof the L-shaped portion 47 of the contact terminal 29 between the coil spring contact 25 and the actuator ring 27. The other end of the coil spring contact 25 is coupled to a contact terminal 30 (not the one shown in FIG. 3*b*) having an L-shaped portion 48 and a termination portion 50 to provide a closed circuit from the external terminal portion 49 of the contact terminal 29 through the coil spring contact and then to the external terminal portion 50.

A bobbin 33 is disposed at the open end of the cap 21 and contains a coil 35 which receives current at terminals (not shown) and retains therein a center post 37 of high magnetic permeability material extending through the center thereof for conducting magnetic flux provided by the coil in standard manner. The center post 37 contacts a steel plate 39 at the open end of the cap 21, steel plate 39 being insulated from the bobbin 33 by a material such as layer 31. The end of the center post 37 is spaced from the slug 23 to provide an air gap therebetween and preferably has a thicker end section 41 extending to the center line of the post and a thinner end section 43 offset from said center line. An essentially D-shaped member 45 of electrically conducting and low magnetic permeability material, preferably copper is positioned on the internal exterior surface of the bobbin 33 and partially surrounds the center post 37. This D-shaped member 45 is well known in such magnetic circuits and prevents collapse of the net magnetic field when the alternating current flow through the wire coil passes through the zero level.

In operation, one end of the coil spring contact 25 is initially biased to be in contact with the contact terminal 29 at the region 47 thereof and the other end of the coil spring contact is in contact with the contact terminal 30 at the region 48 thereof to provide a closed electrical circuit. When the coil 35 is energized due to the application of a current through the lamps of FIGS. 1 and 2, current will flow through the contact terminal 29 and the coil spring contact to the associated lamp filament to provide the required filament current thereto. At the same time, the required operating voltage is applied across the lamps. Also, a magnetic flux field will be induced by the coil 35, this field being carried by the center post 37 and causing the slug 23 to move downwardly to close the gap between the center post and the slug. This downward movement of the slug 23 causes the ring actuator 27 to move downwardly against the coil spring contact 25 and break the contact between the contact 25 and the contact terminal 29 at the portion 47 thereof. The open circuit will cause current to be removed from the filaments, the circuit remaining in this state until current to the coil 35 is removed.

It should be noted that three switch arrangements of the type described hereinabove are disposed in the three pole relay of FIGS. 3*a* and 3*b*, only one of the switches and the operation thereof being described herein. All of the switches will be operated upon actuation of the coil 35 in the manner described hereinabove by commencement of operation of the lamps. It should also be noted that the relay as shown in FIGS. 3*a* and 3*b* can be inserted into an appropriately configured circuit by making contact between the three sets of terminals 49–50 and the appropriately configured circuit.

Figure 4A:
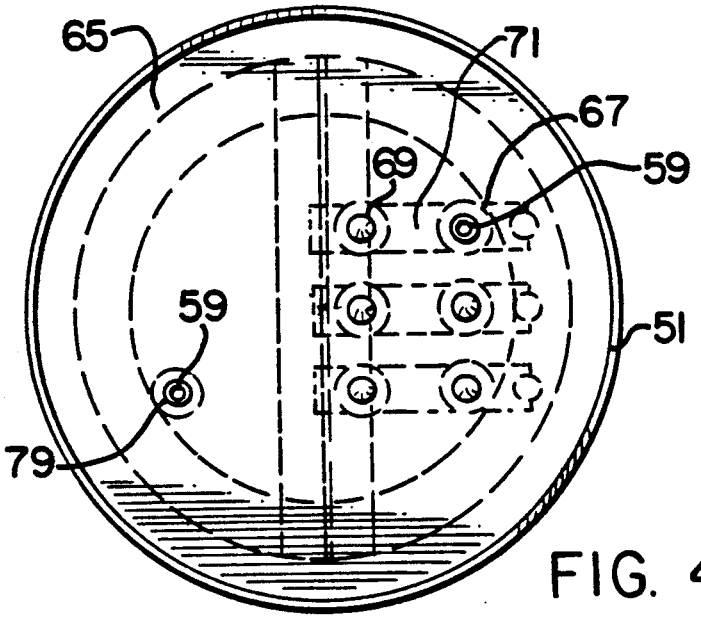
FIGS. 4*a* and 4*b* are a top view and a cross-sectional view respectively of a second embodiment of a relay assembly in accordance with the present invention.
Figure 4B:
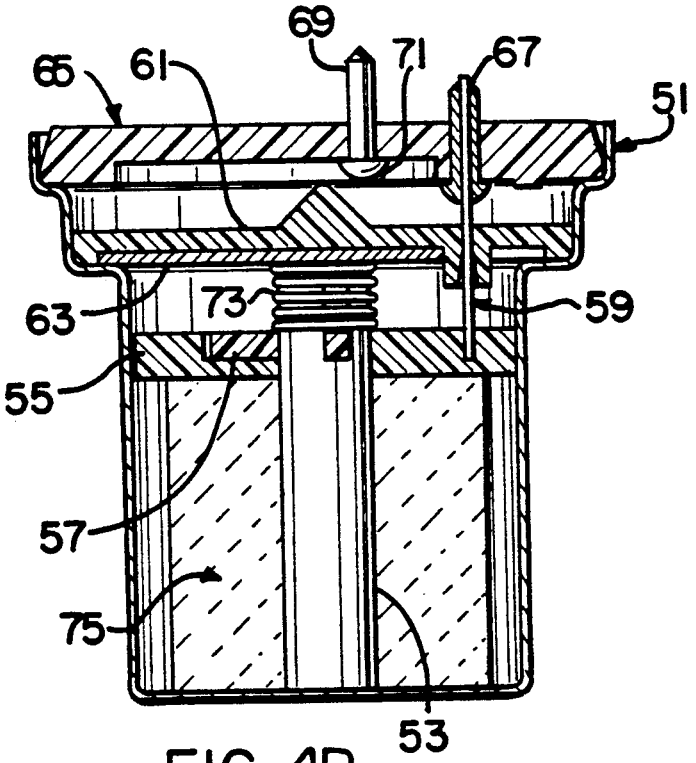

In accordance with the second embodiment of the invention as set forth in FIGS. 4*a* and 4*b*, there is shown a relay in the coil energized and switch open condition having a can 51 of low magnetic permeability which is crimped (crimp not shown) to a cover 65 of plastic. Within the can 51 is a coil 75, this coil corresponding to the BES coil of FIGS. 1 and 2 and being disposed around a center post 53 of low magnetic permeability. The interior end of the coil 75 is secured to a plastic flange 55 which has a shorting turn 57 thereon. The interior end of the center post 53 abuts a steel coin 63 which is secured to a plastic disc 61. The coin 63 and disc 61 a normally biased away from the coil 75 by a compression spring 73.

The cover 65 includes a plurality of solid terminals 69 and a pair of hollow terminals 67 and 79 extending therethrough. Three of the terminals 69 and 67 are each attached to a different one of the contact blades 71 with the coil leads 59 (one not shown in FIG. 4*b*) extending through the hollow terminals 67 and 79. The other three of terminals 69 and 67 are each mated with one of the contact blades 71 only when the coil is not energized since the contact blades are normally biased away from the other three terminals as will be explained hereinbelow.

The knife edge ridge 77 of the plastic disc 61 normally abuts the contact blades 71 to maintain them in a closed position against their bias and against the other three of the terminals 69 and 67 to permit current to flow along all of the contact blades and between the solid terminals 69 or hollow terminal 67 associated therewith and out through another solid terminal 69 or the hollow terminal 67 associated therewith.

In operation, with the coil 75 energized due to the flow of current in the leads 59 and the steel coin 63 and plastic disc 61 attracted toward the coil and against the bias of the spring 73 due to such coil energization, the ridge 77 is withdrawn from impingement against the contact blades 71 and permits the contact blades to move to open the circuit of which they are a part between the terminals 69 and 67. Since three such contact blades 71, which act as switches, are shown, it can be seen that all three circuits, each containing a contact blade, will be opened shortly after energization of the coil 75.

Figure 5:
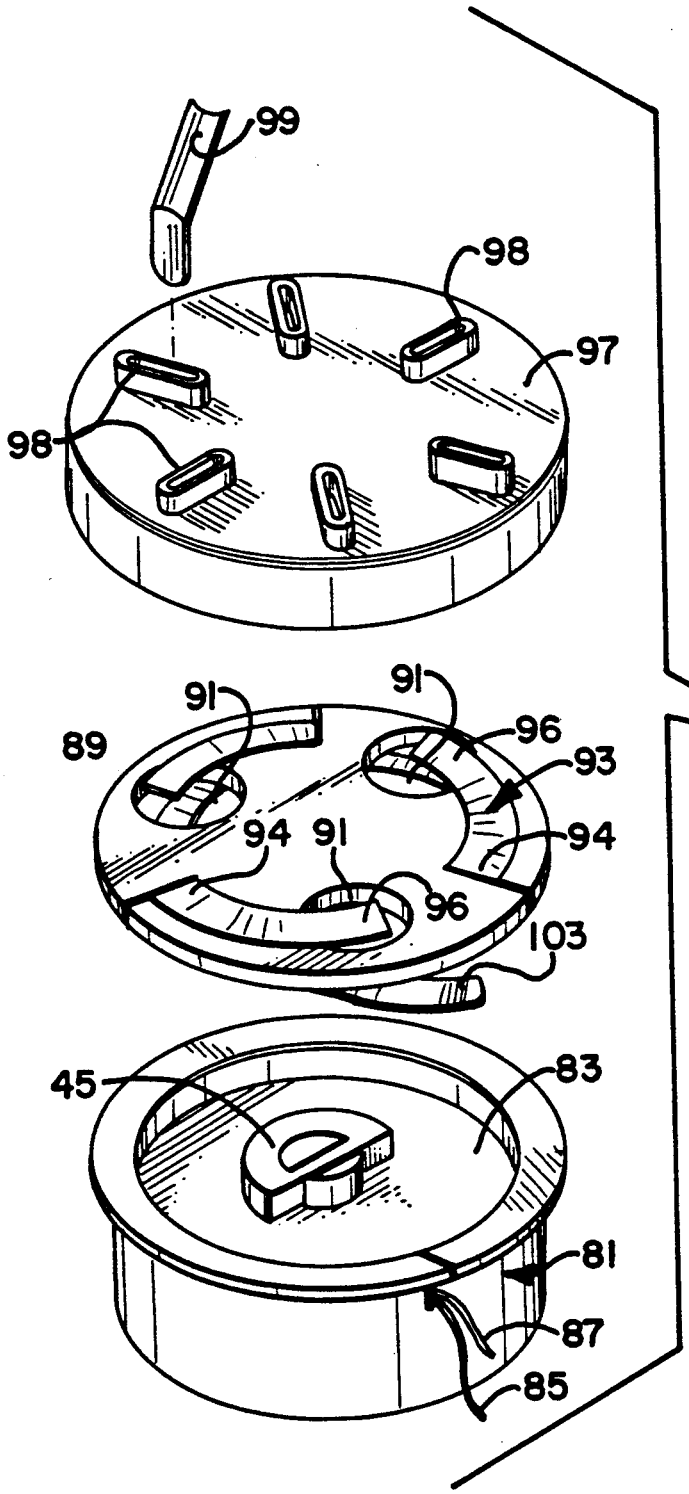
FIG. 5 is an exploded view of a third embodiment in accordance with the present invention.

Referring now to FIG. 5, there is shown an exploded view of a third embodiment in accordance with the present invention. This embodiment includes a can 81 of low permeability magnetic material, preferably steel, having an open end. A bobbin 83, as in FIGS. 3*a* and 3*b*, having a coil 35 with a central core 37 (shown in FIG. 6) is disposed at the closed end of the can with the input and output leads 85 and 87 extending from the can. A shorting turn 45 as in FIGS. 3*a* and 3*b*, preferably formed of copper, is disposed over the bobbin and a slug or coin 89 of high permeability magnetic material and having three apertures 91 therein is disposed over the shorting turn and spaced from the bobbin. Three V-shaped contact ring assemblies 93 are provided with the central portion 94 of each secured to and insulated from the slug and resilient portions 96 and 103 thereof extending outwardly therefrom on opposite sides of the slug. The portion 96 extends over its associated aperture. A cover 97 of electrically insulating and low magnetic permeability material, preferably plastic, is disposed over the slug 89 and forms the top of the can 81. The cover includes six apertures 98 therein, preferably equally spaced about the outer region thereof, each adjacent pair of apertures designed to receive a pair of contacts 99 for connection across one of the coils shown in FIGS. 1 and 2.

Figure 6:
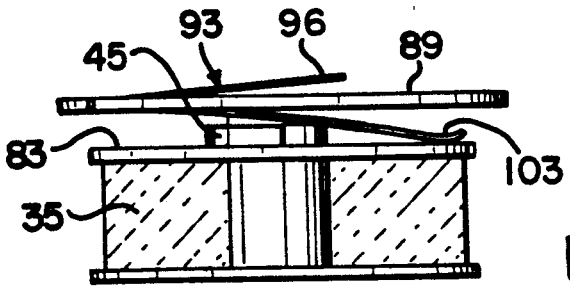
FIG. 6 is a cross sectional view of the embodiment of FIG. 5 in assembled state.
Figure 7:
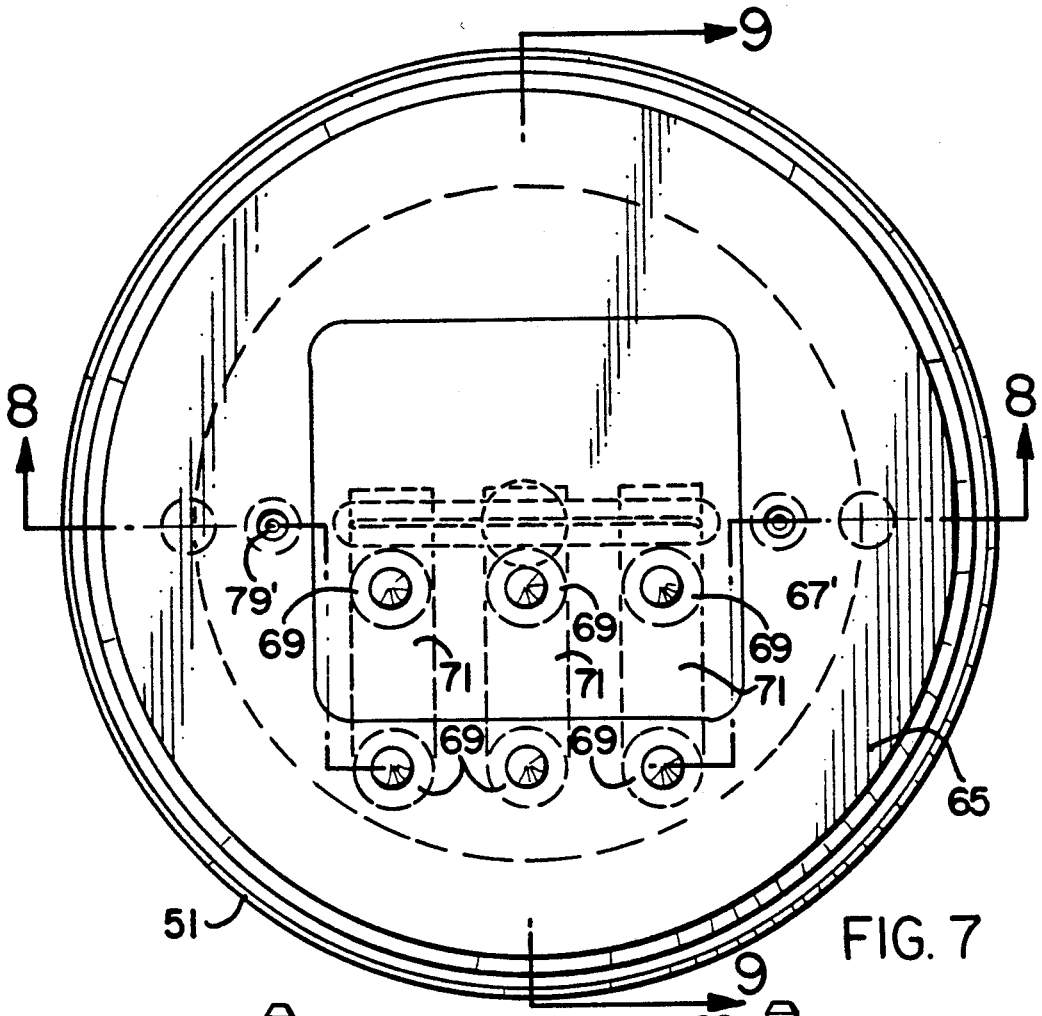
FIG. 7 is a top view of a fourth embodiment in accordance with the present invention.
Figure 8:
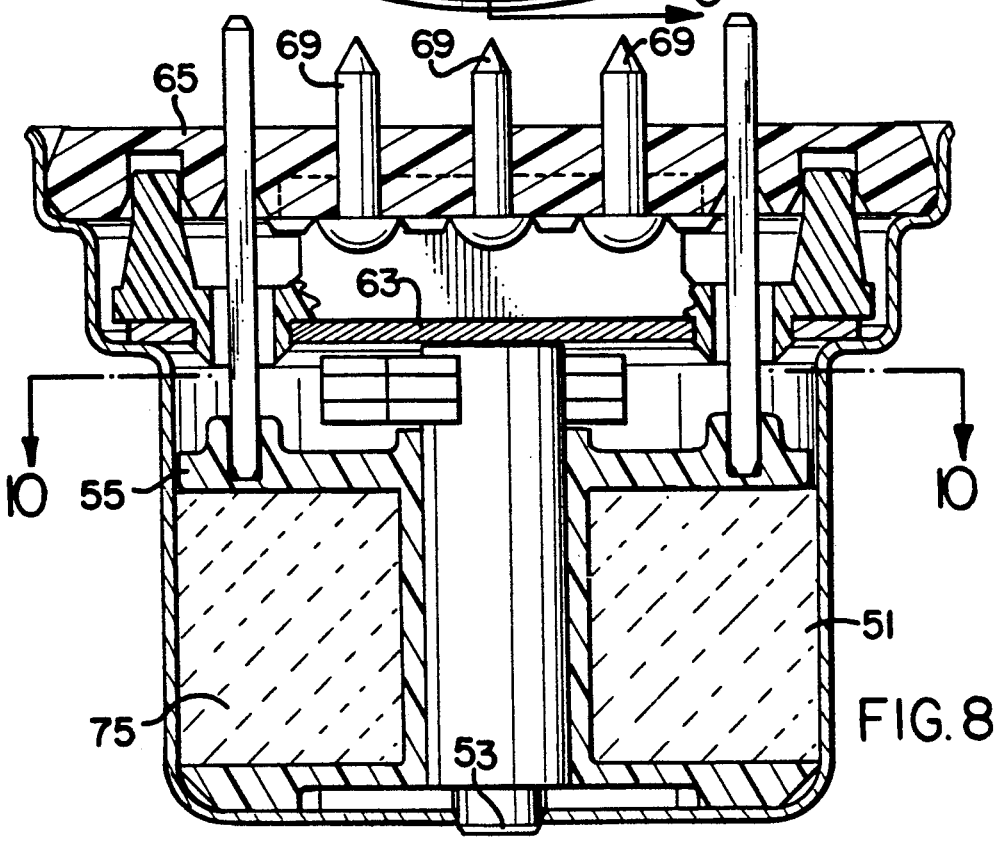
FIG. 8 is a cross sectional view taken along the line 8—8 of FIG. 7.
Figure 9:
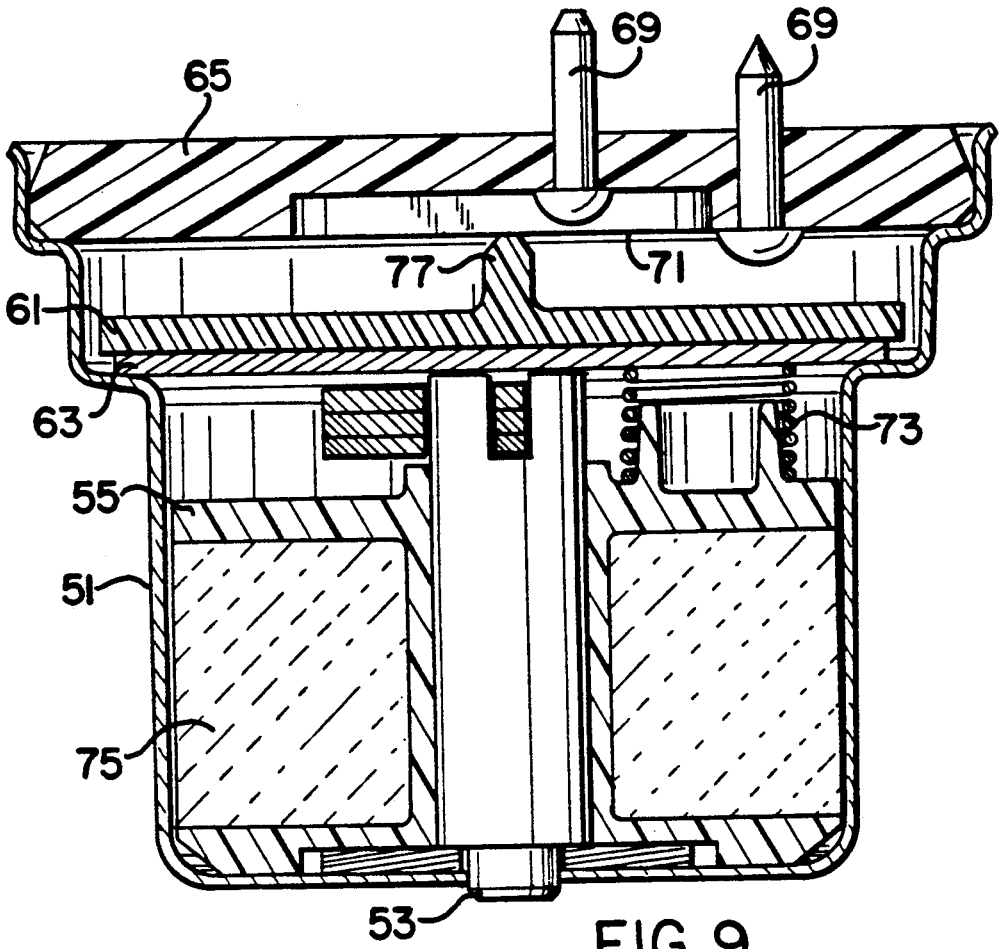
FIG. 9 is a cross sectional view taken along the line 9—9 of FIG. 7.
Figure 10:
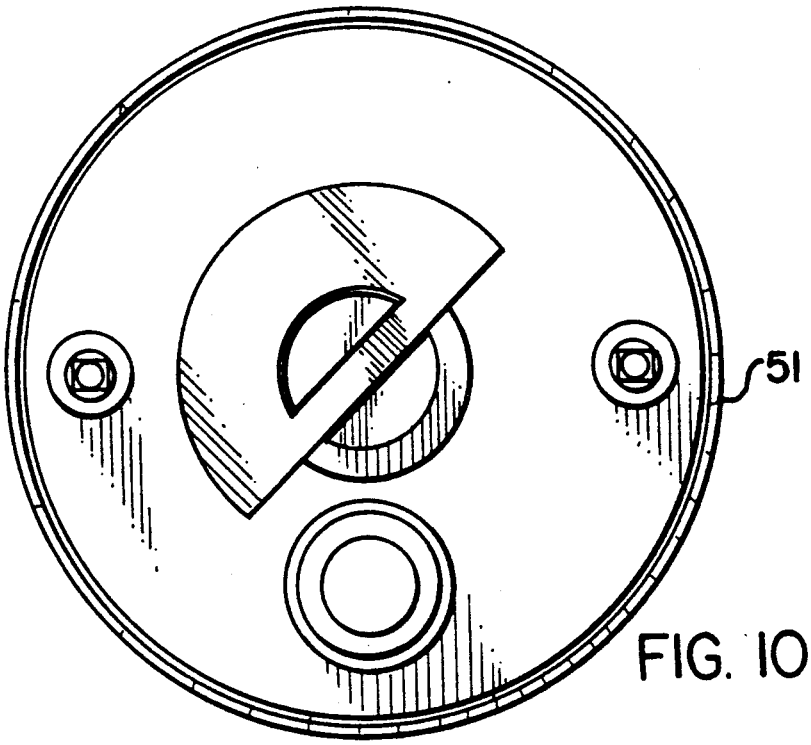
FIG. 10 is a cross sectional view taken along the line 10—10 of FIG. 8.

In operation, as better shown in FIG. 6, a pair of contacts 99 will normally be in contact with the resilient portion 96 which is biased thereagainst by the spring action of the resilient portion 103. When the coil 35 is energized, the slug 89 moves toward the center post 37 against the bias of the spring or resilient portion 103 and breaks contact of the contacts 99 with the resilient portion 96, thereby opening the circuit to the lamp filaments. These contacts will remain in the open position until the coil 35 is deenergized.

FIGS. 7 to 10 represent a fourth embodiment of the invention which is similar to the second embodiment of FIGS. 4*a* and 4*b*. A character references in FIGS. 7 to 10 which are the same as those in FIGS. 4*a* and 4*b* represent the same or similar structure.

The differences between the second embodiment and the fourth embodiment are, first, that the coil spring 73 in the fourth embodiment has been moved off center. This allows the coin 63 to remain in contact with the can 51 at one point in the switch actuated position. In addition, the seven pin configuration of the second embodiment has been replaced with an eight pin configuration. Therefore, the internal connection which would have been made between one coil lead and the stationary terminal of an end switch, through the hollow pin, is now made externally. Further, an actuator guidance system is added. Guidance is provided by the guide posts molded into the actuator and mating locating holes in the cover. In addition, the flange is replace by a full bobbin to improve assemblability and eleminate potential dielectric withstanding voltage problems.

Though the invention has been described with respect to specific preferred embodiments thereof, many variations and modifications will immediately become apparent to those skilled in the art. It is therefore the intention that the appended claims be interpreted as broadly as possible in view of the prior art to include all such variations and modifications.

We claim:

1. A relay for disconnecting fluorescent lamp filaments from the associated filament circuit, which comprises, in combination:

(a) a housing, (b) a magnetic flux producing device disposed within said housing, (c) slug means disposed within said housing and movable toward said magnetic flux producing device in response to magnetic flux from said magnetic flux producing device, and (d) a plurality of switches within said housing, each said switch including a contact and a contact terminal, said slug means normally biasing each said contact against its associated contact terminal to maintain each of said switches in the normally closed state.

2. A relay as set forth in claim 1 wherein at least one of said contact terminals has a hollow interior, said magnetic flux producing means including a coil having a pair of terminals, one of said terminals extending through said contact terminal which has a hollow interior.

3. A relay as set forth in claim 1 wherein said slug means includes a portion of low magnetic permeability and a portion contacting each said contact of electrically insulating material.

4. A relay as set forth in claim 2 wherein said slug means includes a portion of low magnetic permeability and a portion contacting each said contact of electrically insulating material.

5. A relay as set forth in claim 1 further including spring means disposed between said magnetic flux producing means and said slug means normally biasing said slug means against said contacts.

6. A relay as set forth in claim 2 further including spring means disposed between said magnetic flux producing means and said slug means normally biasing said slug means against said contacts.

7. A relay as set forth in claim 3 further including spring means disposed between said magnetic flux producing means and said slug means normally biasing said slug means against said contacts.

8. A relay as set forth in claim 4 further including spring means disposed between said magnetic flux producing means and said slug means normally biasing said slug means against said contacts.

9. A relay as set forth in claim 1 wherein said magnetic flux producing device includes said housing.

10. A relay as set forth in claim 2 wherein said magnetic flux producing device includes said housing.

11. A relay as set forth in claim 3 wherein said magnetic flux producing device includes said housing.

12. A relay as set forth in claim 4 wherein said magnetic flux producing device includes said housing.

13. A relay as set forth in claim 5 wherein said magnetic flux producing device includes said housing.

14. A relay as set forth in claim 6 wherein said magnetic flux producing device includes said housing.

15. A relay as set forth in claim 7 wherein said magnetic flux producing device includes said housing.

16. A relay as set forth in claim 8 wherein said magnetic flux producing device includes said housing.

17. A relay for disconnecting fluorescent lamp filaments from the associated filament circuit, which comprises, in combination:

(a) a housing, (b) a magnetic flux producing device disposed within said housing, (c) a slug disposed within said housing and movable toward said magnetic flux producing device in response to magnetic flux from said magnetic flux producing device, (d) a plurality of resilient contact members secured to said slug, each said resilient contact member having a central portion thereof secured to said slug and first and second portions thereof extending from said central portion disposed on opposite sides of said slug, and (e) a plurality of switches within said housing, each said switch including:

(f) a first contact terminal normally in contact with a central portion of one of said resilient contact members, and (g) a second contact terminal normally in contact with said first portion of said resilient contact member, (h) at least one of said first and second contact terminals being withdrawn from contact with said first portion of said resilient contact member in response to said movement of said slug.

18. A relay as set forth in claim 17 wherein said housing is formed of a high magnetic permeability material and forms a part of the magnetic circuit.

19. A relay as set forth in claim 17 wherein said slug is formed of high magnetic permeability material.

20. A relay as set forth in claim 18 wherein said slug is formed of high magnetic permeability material.

21. A relay as set forth in claim 17 wherein said slug further includes an aperture associated with each said resilient contact member, the end portion of each said first portion extending over its associated aperture.

22. A relay as set forth in claim 18 wherein said slug further includes an aperture associated with each said resilient contact member, the end portion of each said first portion extending over its associated aperture.

23. A relay as set forth in claim 19 wherein said slug further includes an aperture associated with each said resilient contact member, the end portion of each said first portion extending over its associated aperture.

24. A relay as set forth in claim 20 wherein said slug further includes an aperture associated with each said resilient contact member, the end portion of each said first portion extending over its associated aperture.

25. A relay as set forth in claim 17 wherein said second portion of said resilient contact member includes means to normally bias said first portion of said resilient contact member against said at least one of said first and second contact terminals.

26. A relay as set forth in claim 18 wherein said second portion of said resilient contact member includes means to normally bias said first portion of said resilient contact member against said at least one of said first and second contact terminals.

27. A relay as set forth in claim 19 wherein said second portion of said resilient contact member includes means to normally bias said first portion of said resilient contact member against said at least one of said first and second contact terminals.

28. A relay as set forth in claim 20 wherein said second portion of said resilient contact member includes means to normally bias said first portion of said resilient contact member against said at least one of said first and second contact terminals.

29. A relay for disconnecting fluorescent lamp filaments from the associated filament circuit, which comprises, in combination:

(a) a housing, (b) a magnetic flux producing device disposed within said housing, (c) a slug disposed within said housing and movable toward said magnetic flux producing device in response to magnetic flux from said magnetic flux producing device, and (d) a plurality of switches within said housing, each said switch including:

(e) a contact terminal, (f) a spring contact normally biased against said contact terminal, and (g) an actuator ring disposed between said slug and said spring contact and responsive to said movement of said slug to move said spring contact out of contact with said contact terminal, (h) said slug being electrically and magnetically isolated from said contact terminal and said spring contact.

30. A relay as set forth in claim 29, wherein said housing is formed of electrically insulating, low magnetic permeability material.

31. A relay as set forth in claim 29, wherein said actuator ring is formed of electrically insulating, low magnetic permeability material.

32. A relay as set forth in claim 30, wherein said actuator ring is formed of electrically insulating, low magnetic permeability material.

33. A relay as set forth in claim 29 wherein slug is formed of high magnetic permeability material.

34. A relay as set forth in claim 30 wherein slug is formed of high magnetic permeability material.

35. A relay as set forth in claim 31 wherein slug is formed of high magnetic permeability material.

36. A relay as set forth in claim 32 wherein slug is formed of high magnetic permeability material.

* * * * *